US007124451B2

(12) United States Patent
Moore

(10) Patent No.: US 7,124,451 B2
(45) Date of Patent: Oct. 24, 2006

(54) GRAB BAR FOR SHOWER AND THE LIKE

(76) Inventor: Sean A. Moore, 3139 W. Holcombe Blvd., Suite 635, Houston, TX (US) 77025

( * ) Notice: Subject to any disclaimer, the term of this patent is extended or adjusted under 35 U.S.C. 154(b) by 123 days.

(21) Appl. No.: 10/874,061

(22) Filed: Jun. 22, 2004

(65) Prior Publication Data

US 2004/0255376 A1 Dec. 23, 2004

Related U.S. Application Data

(60) Provisional application No. 60/480,679, filed on Jun. 23, 2003.

(51) Int. Cl.
*A47K 3/12* (2006.01)

(52) U.S. Cl. ..... 4/576.1; 248/251; 211/105.1

(58) Field of Classification Search ..... 4/576.1; 248/251; 211/105.6, 123, 105.1
See application file for complete search history.

(56) References Cited

U.S. PATENT DOCUMENTS 2,242,461 A * 5/1941 Fisher ..... 4/576.1
2,388,637 A * 11/1945 John ..... 211/170
5,577,275 A * 11/1996 Guenther ..... 4/576.1
5,690,237 A * 11/1997 Marzec ..... 211/105.1
6,038,714 A 3/2000 Guenther
6,112,344 A 9/2000 Guenther
6,381,769 B1 5/2002 Lofquist, Jr.
6,507,960 B1 1/2003 Kelly

* cited by examiner

*Primary Examiner*—Charles E. Phillips
(74) *Attorney, Agent, or Firm*—Egbert Law Offices

(57) ABSTRACT

A safety grab bar, such as may be used in a shower or a tub enclosure, comprises an inner liner, preferably formed of an extruded metal, and an outer overlying layer, preferably formed of a polymeric material such as plastic. The inner and outer liner mate together with a tongue and groove arrangement to prevent relative rotation between them. The inner liner and the outer overlying layer define the grab bar portion, and terminate at each end in a female receptacle, adapted to receive a male portion of a mounting bracket. The mounting bracket smoothly curves to complete a 90° turn, in order mount into a wall of the shower or bath enclosure. The male and female mating portions are flush at their outer dimensions to provide a smooth, unbroken profile. The male and female portions also include tongue and groove mating surface to prevent rotation of the grab bar within the mounting bracket.

5 Claims, 4 Drawing Sheets

GRAB BAR FOR SHOWER AND THE LIKE

This application claims the benefit of Provisional U.S. Patent Application No. 60/480,679 filed Jun. 23, 2003.

BACKGROUND OF THE INVENTION

The present invention relates generally to a grab bar for use in a bath or shower, and more particularly to a grab bar of field-adjustable length to permit orientation of the grab bar at the discretion of the user.

Each year, many people are injured in falls in the shower or bathtub. These injuries range from slight bruises to broken bones and even death. The injured range in age from young children to elderly people and the injuries are often caused by slipping or simply losing balance. Elderly people are far more likely to fall in the bathtub than are young people and are far more susceptible to serious injury.

For these reasons, many hotels and motels install some sort of support bar on a wall near a shower so people using the shower have a hand hold when entering or exiting the shower or tub. Such grab bars are also commonly installed adjacent to or within bath and shower enclosures in hospitals and rest homes, and even in many residences to help to guard against someone slipping and falling in the shower or bath.

While these support bars work well for some people entering or exiting the shower or tub, they are not always located in the most advantageous position at the most advantageous orientation. For example, in order to provide proper support, the grab bar must be secured mounted into studs or other strong support on the wall, and often standard length grab or support bars do not properly align with studs underlying the walls of the shower or bath. Further, one may find it more convenient to orient the grab bar at an angle relative to the floor of the shower or bath, in order to accommodate the needs of the user. The most common support bars in use today are constructed of a single piece of metal which has been bent to achieve a predetermined length which length cannot be modified to suit the application.

Therefore, there is a need for a grab bar that is located for easy access by someone entering or exiting a tub and that may be easily adjusted upon installation to accommodate the needs of the user. The present invention is directed to filling this need in the art.

Still further, the support bars presently in use often present sharp corners or exposed ends of the grab bar, which in themselves present a safety hazard. Such an aspect is shown and described in U.S. Pat. No. 6,112,344 to Guenther. Even certain grab bars which seek to eliminate such exposed ends or corners too often present uneven surfaces or irregularities in silhouette or profile, which can injure the user. Thus, there also remain a need for a grab bar suitable for installation in a shower or bath which presents a smooth, unbroken profile to eliminate this potential source of injury to the user. The present invention provides such a smooth profile.

SUMMARY OF THE INVENTION

These and other advantages of the present invention are achieved by a safety grab bar comprising an inner liner, preferably formed of an extruded metal, and an outer liner, preferably formed of a polymeric material such as plastic. The inner and outer liner mate together with a tongue and groove arrangement to prevent relative rotation between them. The inner and outer liner define the grab bar portion, and terminate at each end in a female receptacle, adapted to receive a male portion of a mounting bracket. The mounting bracket smoothly curves to complete a 90° turn, in order mount into a wall of the shower or bath enclosure. The male and female mating portions are flush at their outer dimensions to provide a smooth, unbroken profile. The male and female portions also include tongue and groove mating surfaces to prevent rotation of the grab bar within the mounting bracket.

These and other features and advantages of this invention will be readily apparent to those skilled in the art.

BRIEF DESCRIPTION OF THE DRAWINGS

So that the manner in which the above recited features, advantages and objects of the present invention are attained and can be understood in detail, more particular description of the invention, briefly summarized above, may be had by reference to embodiments thereof which are illustrated in the appended drawings.

FIG. 3C is a section view taken along section lines 3C—3C of FIG. 3D.

DETAILED DESCRIPTION OF A PREFERRED EMBODIMENT

Figure 1:
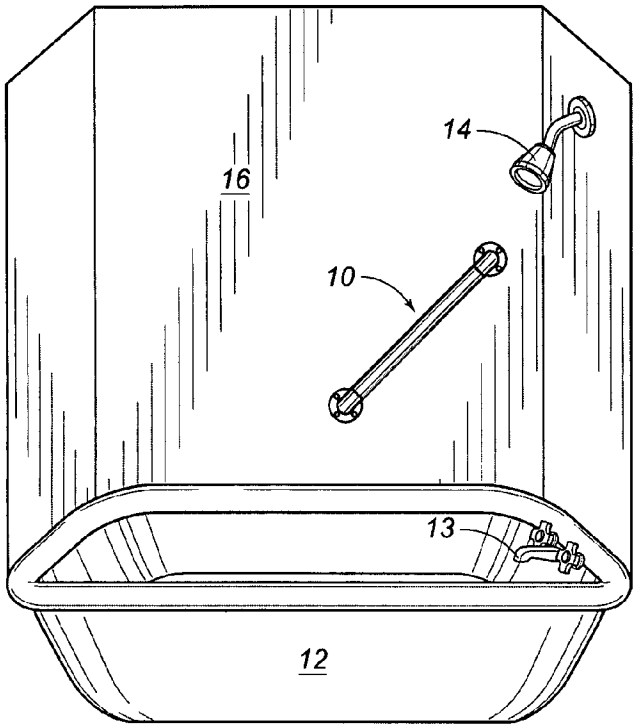
FIG. 1 is a perspective view of a shower structure with a grab bar of the present invention installed therein.

FIG. 1 illustrates a shower enclosure with a grab bat 10 of the present invention. The grab bar 10 is mounted above a bathtub, such as an installed tub 12 with a conventional spigot 13 or a shower nozzle 14 or both. The grab bar is preferably mounted to a side wall 16 at any desired angle for the convenience of the user.

Note that, in a preferred embodiment, the grab bar is provided with a user selectable length, as described below, so that the grab bar can be securely mounted to studs or the like behind the side wall 16 at any angle at the option of the user.

Figure 2:
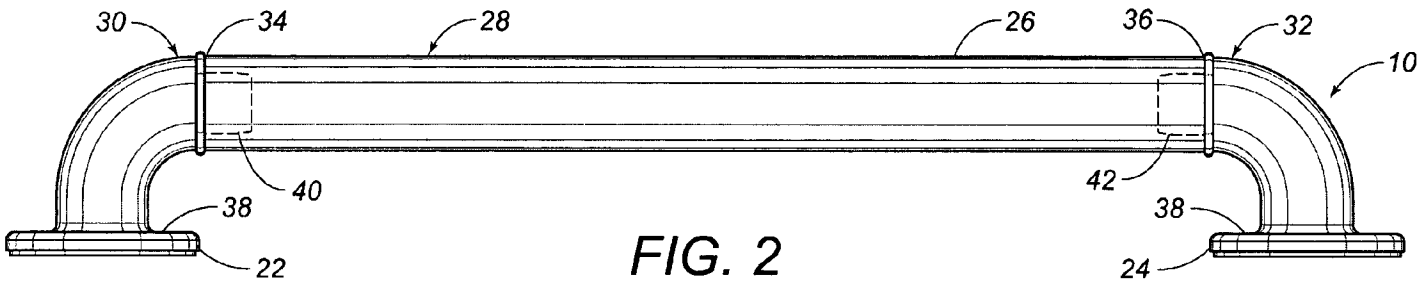
FIG. 2 is a side perspective view of the grab bar of this invention.
Figure 3A:
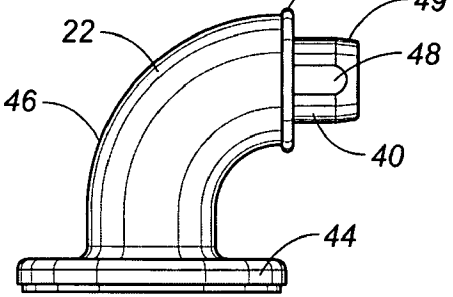
FIGS. 3A through 3F, inclusive, are detail views of a holding bracket of the grab bar.
Figure 3B:
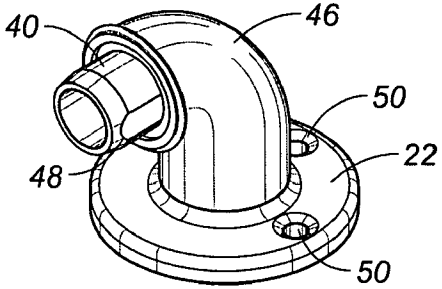
Figure 3C:
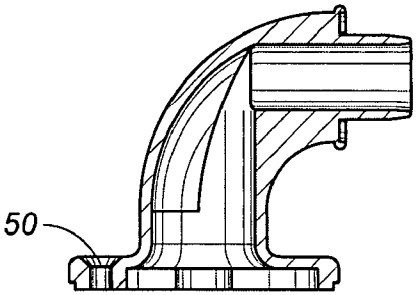
Figure 3D:
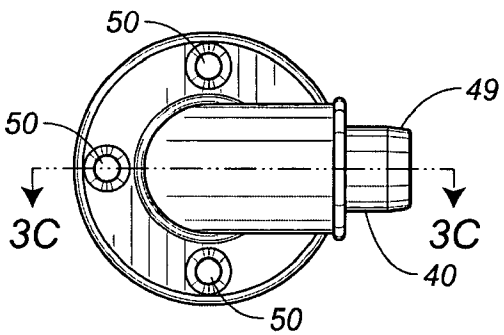
Figure 3E:
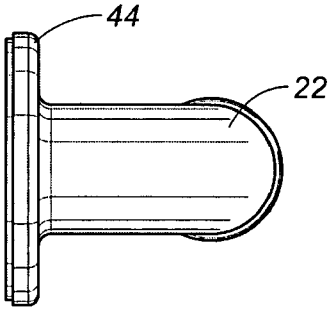
Figure 3F:
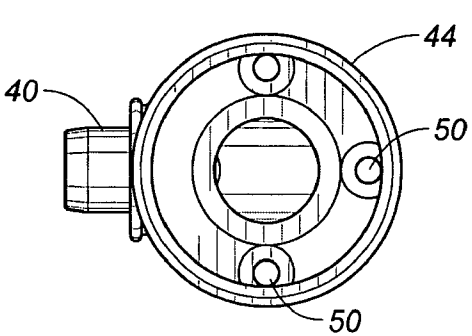

As shown in FIG. 2, the grab bar 10 comprises a first mounting bracket 22, a second mounting bracket 24, and a grab bar section 26 between the brackets. The grab bar section 26 defines an outer diameter 28 which is the same as an outer diameter 30 of the first mounting bracket 22 so that these diameter a but flush to form a first smooth seam 34. Similarly, the outer diameter 28 is the same as an outer diameter 32 of the second mounting bracket 24 to form a second smooth seam 36. Each of the brackets 22 and 24 curves smoothly from its respective seam to a mount 38, shown and described below in greater detail.

As shown in FIG. 2, the mounting brackets and the bar section are formed as separate, distinct elements, and thus are joined with a male member 40 extending from the mounting bracket 22 and a male member 42 extending from the mounting bracket 24, both extending into respective ends of the grab bar section 26. In that way, the mounting brackets may be placed any distance apart, and the grab bar section cut to fit the distance between them. If the grab bar section were provided with the male extensions, then the length of the grab bar section would be set to a predetermined length, which could not be changed in the field.

FIGS. 3A through 3F, inclusive, show various aspects of the mounting brackets 22 and 24. Since the mounting brackets are identical, the reference number 22 is applied to the drawing figures. The mounting bracket comprises a pedestal 44 molded as an integral part of the mounting bracket. An 90° elbow 46 extends first perpendicularly from the pedestal 44 and the horizontally to parallel the side wall 16 (see FIG. 1). The male member 40 extends from an end flange 46 of the mounting bracket, and the male member defines a feature of the preferred embodiment of the invention. The male member includes at least one groove 48 along its entire length to receive a mating element of the grab bar section 26 described below. Preferably, the male member includes a pair of such grooves, one on each side, so that the profile exhibited to the grab bar section is the same in either orientation. The male member further includes a tapered section 49 for ease of assembly of the grab bar of this invention.

The pedestal includes at least two screw holes 50 and preferably three such holes. This prevents the rotation of the mounting brackets and provides for a secure mounting of the assembly.

Figure 4:
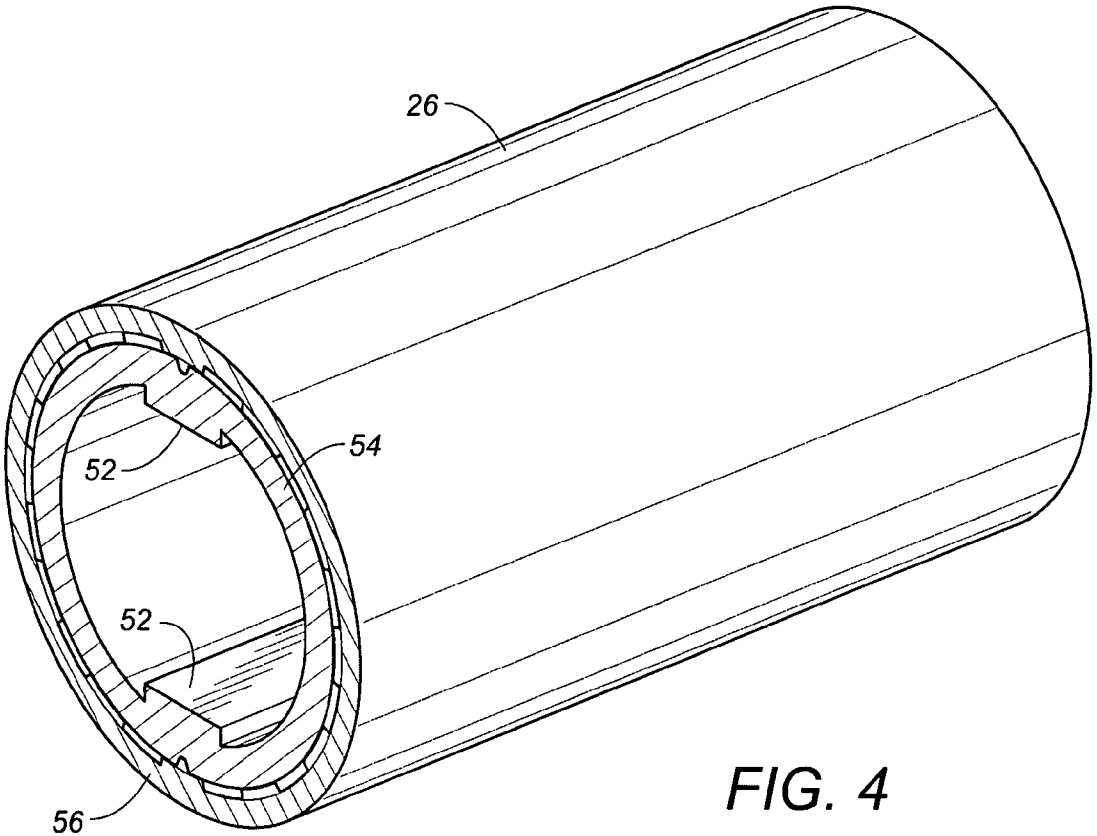
FIG. 4 is a perspective view of a bar which extends between the holding bracket of FIGS. 3A through 3F.
Figure 5A:
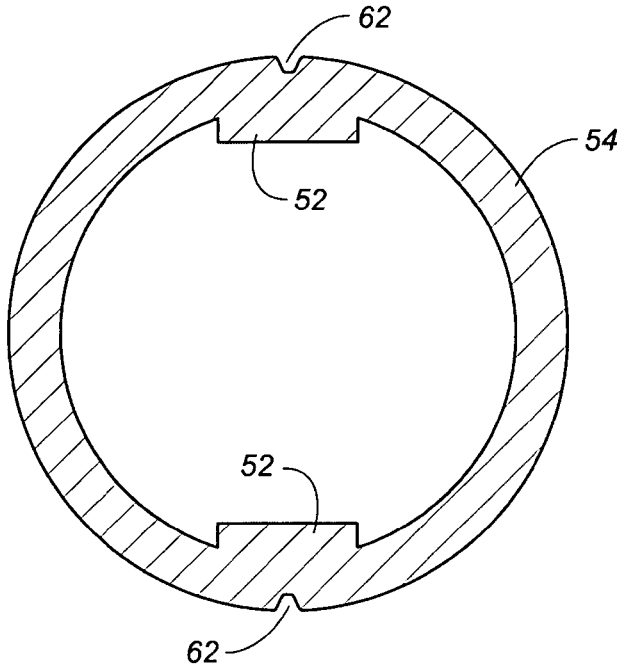
FIG. 5A is a section view of the inner liner of the grab bar.
Figure 5B:
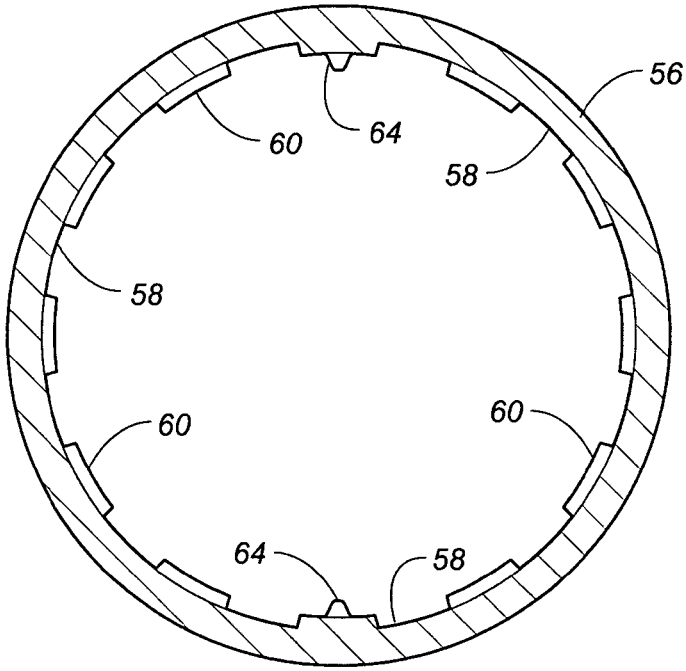
FIG. 5B is a section view of the outer line of the grab bar.

Now that the mounting brackets 22 and 24 have been described in detail, the features of the grab bar section 26 will now be described. These details are shown in FIGS. 4, 5A, and 5B. The grooves 48 (see FIGS. 3A through 3F) are sized and configured to mate with a pair of complementary tongues 52 on a liner 54 inside the grab bar section 26. The liner 54 fits within an overlying plastic layer 56, which has a series of grooves 58 and lands 60 on its interior surface so that the liner 54 can be easily forced into the layer 56. The liner 54 also includes a groove 62 to align with a corresponding tongue 64 to prevent relative rotation of the liner and the layer with respect to one another.

The principles, preferred embodiment, and mode of operation of the present invention have been described in the foregoing specification. This invention is not to be construed as limited to the particular forms disclosed, since these are regarded as illustrative rather than restrictive. Moreover, variations and changes may be made by those skilled in the art without departing from the spirit of the invention.

I claim:

1. A grab bar for attachment to a side wall of a shower enclosure, the grab bar comprising:

a first mounting bracket having a pedestal with a 90° elbow extending therefrom, said pedestal suitable for attachment to the side wall, said 90° elbow having a first portion extending outwardly from said pedestal and an second portion extending transverse to said first portion, said second portion having a mating surface at an end opposite said first portion, said mating surface having a male member extending therefrom, said male member having a groove formed therein;

a second mounting bracket opposing said first mounting bracket, said second mounting bracket having a pedestal with a 90 elbow extending therefrom, said pedestal suitable for attachment to the side wall at a 90° elbow having a first portion extending outwardly from said pedestal of said second mounting bracket said second portion extending transverse to said first portion of said second mounting bracket, said second portion having a mating surface at an end opposite said first portion, second mounting bracket having a mating surface at an end opposite said second portion, said mating surface of said mounting bracket having a male member extending therefrom, and a grab bar section extending between said first and second mounting brackets, said grab bar section having an interior tongue arranged to mate with said groove of said first mounting bracket and said groove of said second mounting bracket, said grab bar section comprising an inner liner and a layer overlying said inner liner, said inner liner having a radially inwardly extending liner groove, said layer having a radially inwardly extending tongue in mating relationship with said liner groove.

2. The grab bar of claim 1, said inner liner being of a metal material, said layer being of a polymeric material.

3. A grab bar for attachment to a side wall of a shower enclosure, the grab bar comprising:

a first mounting bracket having a pedestal with a 90° elbow extending therefrom, said pedestal suitable for attachment to the side wall, said 90° elbow having a first portion extending outwardly from said pedestal and an second portion extending transverse to said first portion, said second portion having a mating surface at an end opposite said first portion, said mating surface having a male member extending therefrom, said male member having a groove formed therein;

a second mounting bracket opposing said first mounting bracket, said second mounting bracket having a pedestal suitable for attachment to the side wall at a 90° elbow having a first portion extending outwardly from said pedestal of said second mounting bracket at a second portion extending transverse to said first portion of said second mounting bracket, said second portion of said 90° elbow so Fundamentally, second mounting bracket having a mating surface at an end opposite said second portion, said mating surface of said mounting bracket having a male member extending therefrom, and a grab bar section extending between said first and second mounting brackets, said grab bar section having an interior tongue arranged to mate with said groove of said first mounting bracket and said groove of said second mounting bracket, said grab bar section comprising an inner liner and a layer overlying said inner liner, said layer having a an inner surface defining a plurality of lands and grooves therein.

4. The grab bar at claim 3, said grab bar having a length dimension.

5. The grab bar of claim 3, each of the male members having a plurality of grooves formed therein.

* * * * *